US008851802B2

(12) United States Patent
Weaver et al.

(10) Patent No.: US 8,851,802 B2
(45) Date of Patent: Oct. 7, 2014

(54) ROCK BOLT

(75) Inventors: Steven Weaver, New South Wales (AU); John Horsch, New South Wales (AU)

(73) Assignee: Sandvik Intellectual Property AB, Sandviken (CH)

( * ) Notice: Subject to any disclaimer, the term of this patent is extended or adjusted under 35 U.S.C. 154(b) by 310 days.

(21) Appl. No.: 12/675,562

(22) PCT Filed: Apr. 30, 2008

(86) PCT No.: PCT/SE2008/000297

§ 371 (c)(1),
(2), (4) Date: Apr. 8, 2010

(87) PCT Pub. No.: WO2009/029012

PCT Pub. Date: Mar. 5, 2009

(65) Prior Publication Data

US 2010/0202838 A1 Aug. 12, 2010

(30) Foreign Application Priority Data

Aug. 31, 2007 (AU) ..... 2007214341

(51) Int. Cl.
*E21D 20/00* (2006.01)
*E21D 21/00* (2006.01)

(52) U.S. Cl.
CPC ..... *E21D 21/008* (2013.01); *E21D 2021/0053* (2013.01); *E21D 21/0026* (2013.01)
USPC ..... 405/259.1

(58) Field of Classification Search
USPC ..... 405/259.1, 259.2, 259.3, 259.4, 259.5, 405/259.6; 411/411
See application file for complete search history.

(56) References Cited

U.S. PATENT DOCUMENTS

| | | | | | |
|---|---|---|---|---|---|
| 1,379,209 | A | * | 5/1921 | Phillips | 411/29 |
| 2,171,985 | A | * | 9/1939 | Mushet | 411/31 |
| 3,653,217 | A | * | 4/1972 | Williams | 405/259.3 |
| 3,702,060 | A | * | 11/1972 | Cumming | 405/259.6 |
| 3,940,941 | A | * | 3/1976 | Libert et al. | 405/259.6 |
| 4,026,186 | A | * | 5/1977 | Williams et al. | 411/29 |
| 4,318,773 | A | * | 3/1982 | Ullrich et al. | 159/47.1 |
| 4,437,795 | A | * | 3/1984 | White | 405/259.3 |
| 4,531,861 | A | * | 7/1985 | Kash | 405/259.6 |

(Continued)

FOREIGN PATENT DOCUMENTS

| | | | |
|---|---|---|---|
| AU | WO 2007059580 | * | 5/2006 |
| AU | WO2007053893 | * | 5/2007 |

(Continued)

OTHER PUBLICATIONS

Official Action against Russian Application No. 2010112389/03(017338), dated Dec. 22, 2011.

(Continued)

*Primary Examiner* — Sunil Singh
*Assistant Examiner* — Patrick Lambe
(74) *Attorney, Agent, or Firm* — Morgan, Lewis & Bockius LLP

(57) ABSTRACT

A hollow rock bolt comprising a shaft having a spiral form protruding from the exterior surface of the shaft, wherein the spiral form has a flank angle of between 30° and 60°.

19 Claims, 2 Drawing Sheets

(56) References Cited

U.S. PATENT DOCUMENTS

| | | | | | |
|---|---|---|---|---|---|
| 4,666,345 | A * | 5/1987 | Seegmiller | 405/259.5 |
| 4,904,123 | A * | 2/1990 | Calandra et al. | 405/259.3 |
| 4,990,042 | A * | 2/1991 | Szayer et al. | 411/29 |
| 5,183,357 | A * | 2/1993 | Palm | 411/29 |
| 5,297,909 | A * | 3/1994 | Tsay et al. | 411/29 |
| 5,437,526 | A * | 8/1995 | Herbst et al. | 411/257 |
| 5,664,900 | A * | 9/1997 | Matthies | 403/297 |
| 5,794,985 | A * | 8/1998 | Mallis | 285/93 |
| 6,029,417 | A * | 2/2000 | Leibhard et al. | 52/705 |
| 6,227,782 | B1 * | 5/2001 | Bowling et al. | 411/114 |
| 6,829,871 | B1 * | 12/2004 | McSherry et al. | 52/705 |
| 7,217,195 | B2 * | 5/2007 | Matsubayashi | 470/10 |
| 2002/0046535 | A1 * | 4/2002 | Ludwig et al. | 52/698 |
| 2006/0216190 | A1 * | 9/2006 | Beaven et al. | 418/201.1 |
| 2006/0263171 | A1 * | 11/2006 | Schwarz | 411/411 |
| 2007/0217869 | A1 * | 9/2007 | Dawe | 405/259.4 |
| 2007/0243026 | A1 * | 10/2007 | Wu et al. | 405/259.6 |
| 2008/0008553 | A1 * | 1/2008 | Gillis et al. | 411/15 |
| 2008/0038068 | A1 * | 2/2008 | Craig | 405/259.3 |
| 2009/0041550 | A1 * | 2/2009 | Oldsen et al. | 405/259.3 |
| 2009/0220309 | A1 * | 9/2009 | Weaver et al. | 405/259.3 |
| 2009/0324343 | A1 * | 12/2009 | Eigemann et al. | 405/259.5 |
| 2010/0003088 | A1 * | 1/2010 | Grocholewski et al. | 405/259.5 |
| 2010/0098500 | A1 | 4/2010 | Weaver et al. | |
| 2010/0202838 | A1 * | 8/2010 | Weaver et al. | 405/259.1 |
| 2010/0278593 | A1 * | 11/2010 | Cook | 405/259.3 |
| 2010/0310323 | A1 * | 12/2010 | Dodds et al. | 405/259.5 |
| 2011/0002745 | A1 * | 1/2011 | Meidl et al. | 405/259.1 |
| 2011/0070034 | A1 * | 3/2011 | Schmidt | 405/259.1 |
| 2011/0206468 | A1 * | 8/2011 | Ayrle | 405/259.1 |

FOREIGN PATENT DOCUMENTS

| | | | |
|---|---|---|---|
| AU | WO2007059580 | * | 5/2007 |
| CN | 1317627 | A | 10/2001 |
| EP | 0 794 336 | | 9/1997 |
| RU | 2201506 | C2 | 3/2003 |
| RU | 29748 | U1 | 5/2003 |
| RU | 2280166 | C2 | 7/2006 |
| RU | 2292459 | C1 | 1/2007 |
| WO | 03/102374 | | 12/2003 |
| WO | 2007/053893 | | 5/2007 |
| WO | 2007/059580 | | 5/2007 |
| WO | WO 2008/060211 | | 5/2008 |

OTHER PUBLICATIONS

Notification of the First Office Action against Chinese Application No. 200880103886.5, dated Sep. 23, 2011.

* cited by examiner

ROCK BOLT

The present invention relates to rock bolts for use in the mining and tunnelling industry to provide roof and wall support and prevent rock collapse.

BACKGROUND OF INVENTION

Reinforcement of hard rock strata as well as soft strata for preventing rock collapse is carried out using support systems incorporating rock bolts. The rock bolts are inserted into holes drilled into rock and secured there by resin or cement based grout applied in the holes.

To consolidate the separate steps of drilling a hole in rock then inserting and fixing a rock bolt in the drilled hole, self drilling rock bolts are used. Self drilling rock bolts can be drilled into rock and anchored therein in one pass.

Problems have occurred with both regular rock bolts and self drilling rock bolts where the rock bolts become loose from the grout and become unstable. This can occur as a result of movement in the rock strata or as a result of the load imparted on the rock bolt by the rock support system. Danger arises where a rock bolt becomes unstable because there is a possibility that the rock bolt will pull free of rock which can lead to rock collapse. Improving the safety of rock support systems and avoiding rock collapse are important issues in the mining and tunnelling industry.

SUMMARY OF THE INVENTION

In accordance with the present invention there is provided a hollow rock bolt comprising a shaft having a spiral form protruding from the exterior surface of the shaft, wherein the spiral form has a flank angle of between 30° and 60°.

The spiral form is preferably formed by a cold rolling technique which increases the yield strength of the shaft material, generally steel. This in turn increases the stiffness of the rock support.

The flank angle, which can be seen by viewing the spiral form in profile, is preferably about 45°. Having the flank angle in the range of 30° to 60°, and preferably 45°, provides for an improved drilling action when the rock bolt is a self-drilling rock bolt and provides for optimum fixing ability between the bolt and rock strata after the rock bolt is grouted into a hole in the rock strata.

The spiral form is preferably a thread having a pitch of between 7 mm and 20 mm and a height of between 1 and 4 mm. The spiral form is preferably a right handed thread that is continuous along a major portion of the shaft length. The shaft length is usually between 0.5 and 5 meters.

In a preferred embodiment the rock bolt is a self drilling rock bolt where the shaft has a drilling end, a mounting end and a hollow channel extending between the drilling end and the mounting end. A drill tip is provided at the drilling end.

At or towards the drilling end, the shaft has a left handed attachment thread with a pitch less than that of the spiral form. The attachment thread is for receiving an anchoring device used to anchor the rock bolt in a drilled hole before grouting. The drilling end of the rock bolt is provided with an internal right handed thread for receiving the drill bit.

The shaft of the rock bolt at the mounting end may also be provided with a mounting thread having a pitch less than the pitch of the spiral form to allow the rock bolt to be attached to a drilling apparatus by way of a drive coupler to mount the rock bolt. Alternatively, the drive coupler can be integral with the shaft.

In accordance with the present invention there is further provided a method of forming a hollow rock bolt including passing a cold drawn hollow shaft through first thread rollers and cold forming a spiral form to protrude from the exterior surface of the shaft, the spiral form having a flank angle of between 30° and 60°.

Preferably the cold forming technique is continued through to a second roller assembly and a third roller assembly to form a first attachment thread at a drilling end of the shaft, the first attachment thread having an opposite hand to the spiral form, and a second attachment thread at a mounting end of the shaft, the second attachment thread having the same handedness as the spiral form.

BRIEF DESCRIPTION OF THE DRAWINGS

The invention will be described in more detail in the attached drawings, in which.

DETAILED DESCRIPTION OF PREFERRED EMBODIMENT

Figure 1:
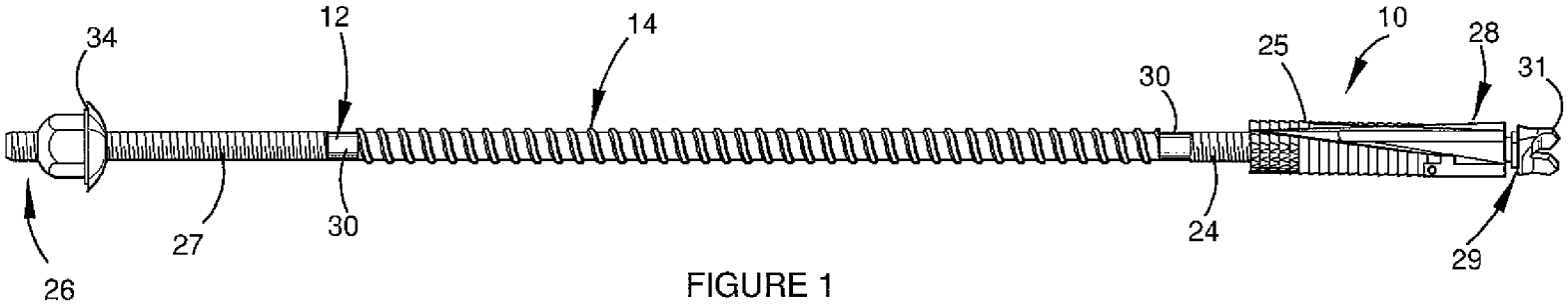
FIG. 1 is a side view of a rock bolt in accordance with an embodiment of the present invention.

The drawings illustrate a self drilling rock bolt having features that improve the bolt's drilling, fixing, and anchoring, capabilities when drilled and cemented, or grouted, in a hole. It is understood that while the preferred embodiment as illustrated is a self drilling rock bolt, the invention equally applies to hollow rock bolts that are not self drilling, that is rock bolts that are inserted into a pre-drilled hole. It is also appreciated that the rock bolt may not be hollow all the way through, but may be solid along at least a portion of its length.

The rock bolt 10 as illustrated in the drawings comprises a shaft 12 that has a spiral form protruding from an exterior surface 13 of the shaft wherein the spiral form has a flank angle $\alpha$ of between 30° and 60° relative to a normal axis N on (that is, perpendicular to) the surface 13 of the shaft 12.

For convenience, the spiral form is described as a fixing thread 14 because one of the main functions of the spiral form is to fix, or anchor, the rock bolt 10 in a column of grout 16 (FIG. 5) that has been poured into a drilled hole 18, whether the drilled hole is created by the rock bolt itself in a self-drilling operation or by a separate drilling operation.

Figure 3:
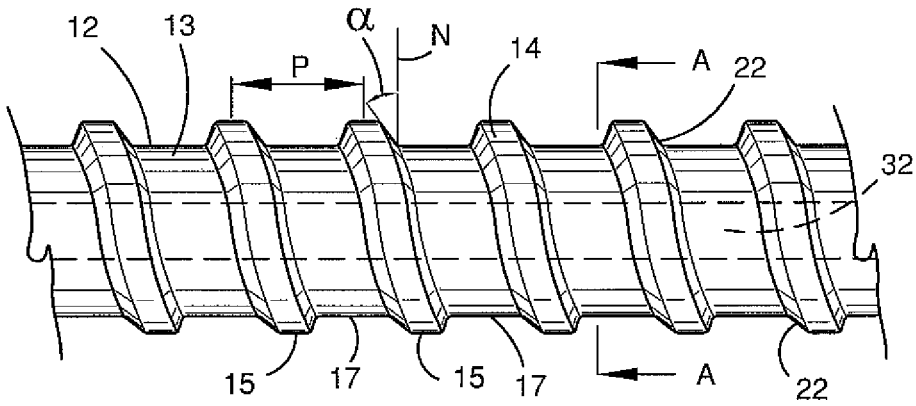
FIG. 3 is an enlarged view of a threaded portion of the rock bolt.
Figure 5:
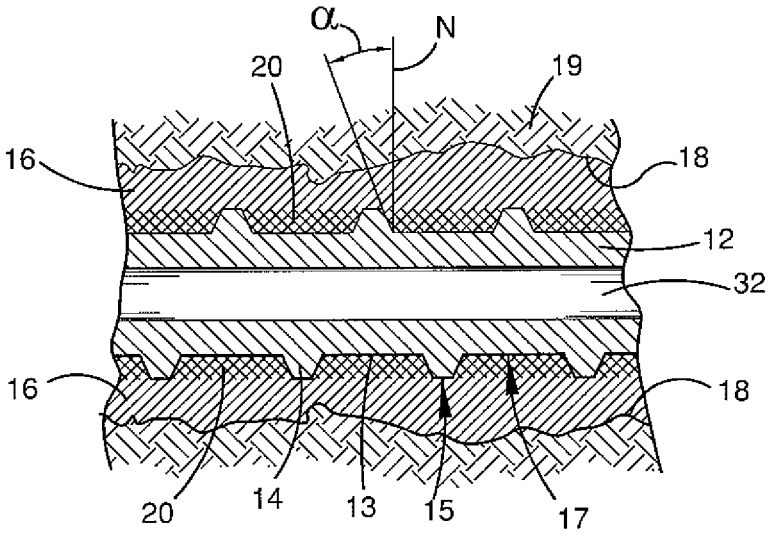
FIG. 5 is a side cross section of the rock bolt embedded in situ.

The fixing thread 14 creates a mechanical lock between the rock bolt and rock strata 19 through the grout column 16. Flank angle $\alpha$ is best seen in FIGS. 3 and 5 which closely illustrate the fixing thread 14 in profile where the flank walls 22 form an angle $\alpha$ with the normal axis N on the surface 13 of shaft 12. Flank walls 22 form the ascending and descending walls of the crest 15 of the fixing thread 14.

A rock bolt having a fixing thread, or spiral form, with a flank angle in the range described has several advantages. In a self-drilling operation the spiral form propels rock cuttings and shavings away from the drill tip and the flank angle assists in pushing the cuttings into the annulus of the hole surrounding the rock bolt assisting in keeping the debris moving and flushing out of the hole.

In both a self-drilling operation and where a separate drilling operation is used to drill the hole, once the rock bolt is in place in hole 18 and grout is poured and sets, the flank angle has the advantage of optimally transferring a load between the rack bolt and the rock strata minimising shearing stresses on the fixing thread when, in use, the bolt experiences axial tension.

The forces transferred from a flank angle of between 30° and 60° and preferably 45° optimises and evenly distributes the compressive forces between the rock bolt and rock strata to minimise concentrated forces on the fixing thread. This in turn provides, through grout block 20 (FIG. 5), increased cohesion between the rock bolt and grout and improves structural integrity and strength of the rock bolt installation.

To increase the structural integrity of the rock bolt installation and strength of the rock itself, the rock bolt 10 in the preferred embodiment is formed by cold forming techniques as opposed to hot working the spiral form onto the exterior surface of the shaft. It is of course understood that while cold working techniques are preferred, hot rolling techniques may still be used.

Cold working the hollow rock bolt would comprise beginning the process with a cold drawn seamless hollow tube, or shaft. A seamed tube is also possible. The cold drawn seamless would have the best strength and roundness tolerances. A seamed tube would be weaker, less accurate but cheaper. The hollow shaft is then fed, or passed, through a first assembly of thread rollers for cold forming the spiral formation (fixing thread 14) on the exterior surface 13 of shaft 12. Other threads that may be incorporated on to the shaft, as discussed below, are cold formed by passing the shaft through further cold roller assemblies.

Other manufacturing techniques to cold roll forming may be used to form the fixing thread with the desired flank angle, for example chip removing machining.

The rock bolt 10 as illustrated in the drawings is typically 0.5 meters to 5.0 meters in length. The fixing thread 14 has a pitch P of at least 7 mm and a maximum pitch of 20 mm. The pitch of the thread is measured as the distance between the crests 15 or troughs 17 of the thread.

The fixing thread having a pitch of at least 7 mm can assist in achieving a suitable mechanical lock between a rock bolt 10 and grout 16. In one embodiment a preferred pitch is approximately 10 mm. The large pitch of the thread also acts as an auger during drilling, helping to remove the cuttings from the hole.

Figure 2:
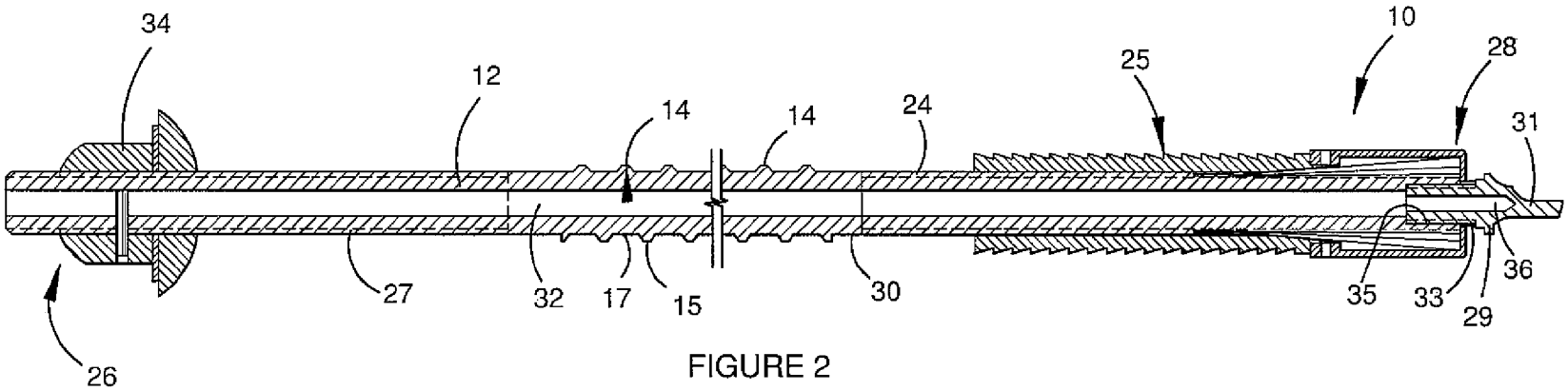
FIG. 2 is a cross-sectional side view of the rock bolt.

In the embodiment illustrated in FIGS. 1 and 2, the fixing thread 14 is provided as a continuous helical thread along a major portion of shaft 12 and, in this embodiment, along at least half the shaft's length. Hence, the debris clearing and fixing attributes of the rock bolt are provided along a substantial portion of the shaft. It is however understood that the fixing thread need not be continuous along the shaft's length but may instead be broken into segmented thread sections or as otherwise required depending on the additional functions required of the rock bolt The depth of the fixing thread may vary depending on the length of the rock bolt, its specific application in a particular rock strata, the grout type used, the wall thickness, and the diameter and material properties of the bolt itself. For a rock bolt having a shank length of at least 1 meter it is envisaged that a suitable depth of fixing thread would be between 1-4 mm In the embodiment shown, the fixing thread of the self drilling rock bolt is a right handed thread. An anchor attachment thread 24 is provided at a drilling end 28 of the shaft for receiving an anchoring device 25 which features in one preferred embodiment of the self drilling rock bolt and as illustrated in FIGS. 1 and 2. The attachment thread 24 towards the drilling end 28 of the shaft is spaced from the fixing thread 14 by a gap 30. Attachment thread 24 is a regular thread provided on rock bolts in that the thread has a pitch of approximately less than 5 mm, typically 2.5 to 3.0 mm.

As illustrated in FIG. 1, self drilling rock bolt 10 includes a mounting end 26 and a drilling end 28. The mounting end 26 is provided with a mounting thread 27 in order to allow the rock bolt 10 to be mounted to a drilling apparatus (not shown) by way of a drive coupler 34 such that the drilling apparatus can impart rotation and thrust to the rock bolt 10. The mounting thread 27 also has a pitch of less than 5 mm.

Using the preferred cold rolling techniques to form the rock bolt as described above, attachment thread 24 and mounting thread 27 are also formed by cold working a cold drawn seamless hollow tube before or after the fixing thread is cold formed in separate cold working steps by passing the tube through roller assemblies and separately forming the attachment thread and mounting thread.

In the preferred embodiment the attachment thread 24 is a left handed thread which allows the anchoring device 25 to be activated once the self drilling rock bolt has completed its drilling operation. The anchoring device 25 which is coupled to attachment thread 24, is activated in the drilled hole to anchor the rock bolt 10 in position in the hole in preparation for grouting. For additional information on self drilling rock bolts, reference is made to a co-pending patent application WO 2007/053893, the content of which is incorporated herein by reference. To avoid activation of the anchoring device during drilling, attachment thread 24 is left handed which will allow the anchoring device to move with the drilling direction and remain inactivated.

Figure 4:
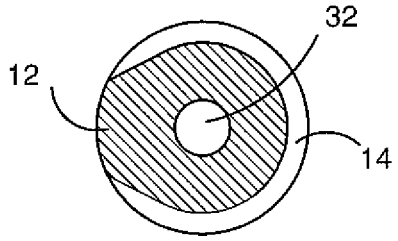
FIG. 4 is an end sectional view taken through section A-A of FIG. 3.

As illustrated in FIG. 4, shaft 12 includes a hollow central passage longitudinally therethrough which is a flush channel 32 allowing fluid to be passed from the mounting end 26 of the shaft to the drilling end 28 for flushing drilled rock away from the drilling end during drilling.

The drilling end 28 incorporates a drill bit 29 having a drill tip 31. The drill bit 29 is provided with an external thread 33 at the opposite end of the drill tip 32 for connecting the drill bit to the rock bolt shaft 12. At the very end of drilling end 28 of shaft 12 the flush channel 32 is provided with an inner thread 35 which is complementary to the external thread 33 of the drill bit 29 so that the drill bit can be screwed on to the end of shaft 12. The drill bit also contains an internal passage 36 that is in communication with flush channel 32.

The threaded coupling between the drill bit and shaft 12 is a right handed thread so that during a drilling operation, which typically induces right hand rotation of the shaft, the threaded coupling between the drill bit and shaft tightens.

As already discussed, the rock bolt need not be a self drilling rock bolt. In this case the rock bolt may have a partially solid shaft and may not necessarily be provided with any other threads other than the fixing thread 14 because the rock bolt may be manually inserted into a drilled hole.

The present rock bolt having a fixing thread with a flank angle $\alpha$ of between 30° and 60° results in marked improvements in the cohesion of the rock bolt with grout in a grout column and improved strength to the bolt. This in turn improves the structural integrity of the support system used for retaining rock. Cold forming the rock bolt 10 further increases the bolt strength, and more specifically the bolt's yield strength.

It will be understood to persons skilled in the art of the invention that many modifications may be made without departing from the spirit and scope of the invention.

The disclosures in the Australian patent application No. 2007214341, from which this application claims priority are incorporated herein by reference.

The invention claimed is:

1. A hollow rock bolt comprising a shaft having a spiral form protruding from the exterior surface of the shaft, wherein the spiral form has a flank angle of between 30° and 60°, wherein the rock bolt further has a mounting end, an opposite drilling end and a hollow channel therebetween, wherein the drilling end is provided with a first attachment thread for attaching an anchoring device to the shaft and the mounting end is provided with a second attachment thread, wherein the first attachment thread has a handedness that is opposite from a handedness of the spiral form, and wherein the second attachment thread has the same handedness as the spiral form.

2. The rock bolt according to claim 1 wherein the spiral form has a pitch of between 7 and 20 mm.

3. The rock bolt as claimed in claim 1 wherein the spiral form has a height of between 1 and 4 mm.

4. The rock bolt claimed in claim 1 wherein the spiral form and the shaft are a metallurgical unitary body.

5. The rock bolt claimed in claim 1 wherein the flank angle is approximately 45°.

6. The rock bolt claimed in claim 1 wherein the spiral form is a right handed thread.

7. The rock bolt claimed in claim 1 wherein the spiral form is a continuous thread along a major portion of the shaft length.

8. The rock bolt claimed in claim 1 wherein the shaft length is between 0.5 and 5 meters.

9. The rock bolt claimed in claim 1 wherein the rock bolt is a self-drilling rock bolt.

10. The rock bolt claimed in claim 9 wherein the first attachment thread has a pitch or profile that is different to the pitch and profile of the spiral form.

11. The rock bolt claimed in claim 1 wherein the first attachment thread has a smaller pitch than the spiral form.

12. The rock bolt claimed in claim 1 wherein the second attachment thread at the mounting end is for attaching a drive coupler to the shaft, and wherein the second attachment thread has a smaller pitch than the spiral form.

13. The rock bolt claimed in claim 1 wherein the spiral form is first a left handed thread.

14. The rock bolt claimed in claim 1 wherein the drilling end of the shaft is provided with an inner thread open to an end surface of the shaft for threaded connection of a drill bit.

15. A self-drilling rock bolt comprising a shaft having a mounting end provided with a mounting thread, an opposite drilling end provided with an anchor attachment thread for supporting an anchoring device, and a hollow channel extending through the shaft between the mounting end and drilling end; the shaft having a spiral form protruding from the exterior surface of the shaft between the mounting thread and anchor attachment thread, wherein the spiral form has a flank angle of between 30° and 60°, wherein the anchor attachment thread and the mounting thread have a handedness that is the same, and wherein both the anchor attachment thread and the mounting thread have a handedness that is different from a handedness of the spiral form.

16. The self-drilling rock bolt claimed in claim 15 wherein the spiral form, mounting thread and anchor attachment thread and shaft are a metallurgical unitary body.

17. The rock bolt claimed in claim 15 wherein the flank angle is approximately 45°.

18. The rock bolt claimed in claim 15, wherein a portion of the hollow channel at the drilling end of the shaft is provided with an inner thread for threaded connection of a drill bit.

19. The rock bolt claimed in claim 18, wherein the inner thread is a right handed thread.

* * * * *